United States Patent [19]

Gooden

[11] Patent Number: 4,590,954

[45] Date of Patent: May 27, 1986

[54] PROCESS FOR PACKAGING LEAF TOBACCO

[76] Inventor: Eldon D. Gooden, 9916 Oldfield Dr., Richmond, Va. 23235

[21] Appl. No.: 649,478

[22] Filed: Sep. 11, 1984

[51] Int. Cl.[4] ..... A24B 15/22

[52] U.S. Cl. ..... 131/299; 131/301; 131/302

[58] Field of Search ..... 131/290, 299, 301, 302

[56] References Cited

U.S. PATENT DOCUMENTS

| | | | |
|---|---|---|---|
| 2,124,012 | 7/1938 | Smith, Jr. | 131/299 |
| 3,699,976 | 10/1972 | Abe et al. | 131/299 |
| 3,820,549 | 6/1974 | Flingbaugh | 131/299 |

*Primary Examiner*—V. Millin

*Attorney, Agent, or Firm*—Cushman, Darby & Cushman

[57] ABSTRACT

A method of treating leaf tobacco for storage includes removing the stems from the tobacco leaves, tightly packing the leaves in a container that is non-conductive and while the leaves have a relatively high moisture content; subjecting the packed leaves to a heat treatment by exposing the packed container to an electromagnetic field to heat the leaves to a temperature of approximately 180°; subsequently subjecting the packed leaves to a high vacuum to reduce the moisture content thereof and to reduce the temperature of the leaves; the packed container may also be subjected to a low temperature treatment while being subjected to the vacuum.

12 Claims, 1 Drawing Figure

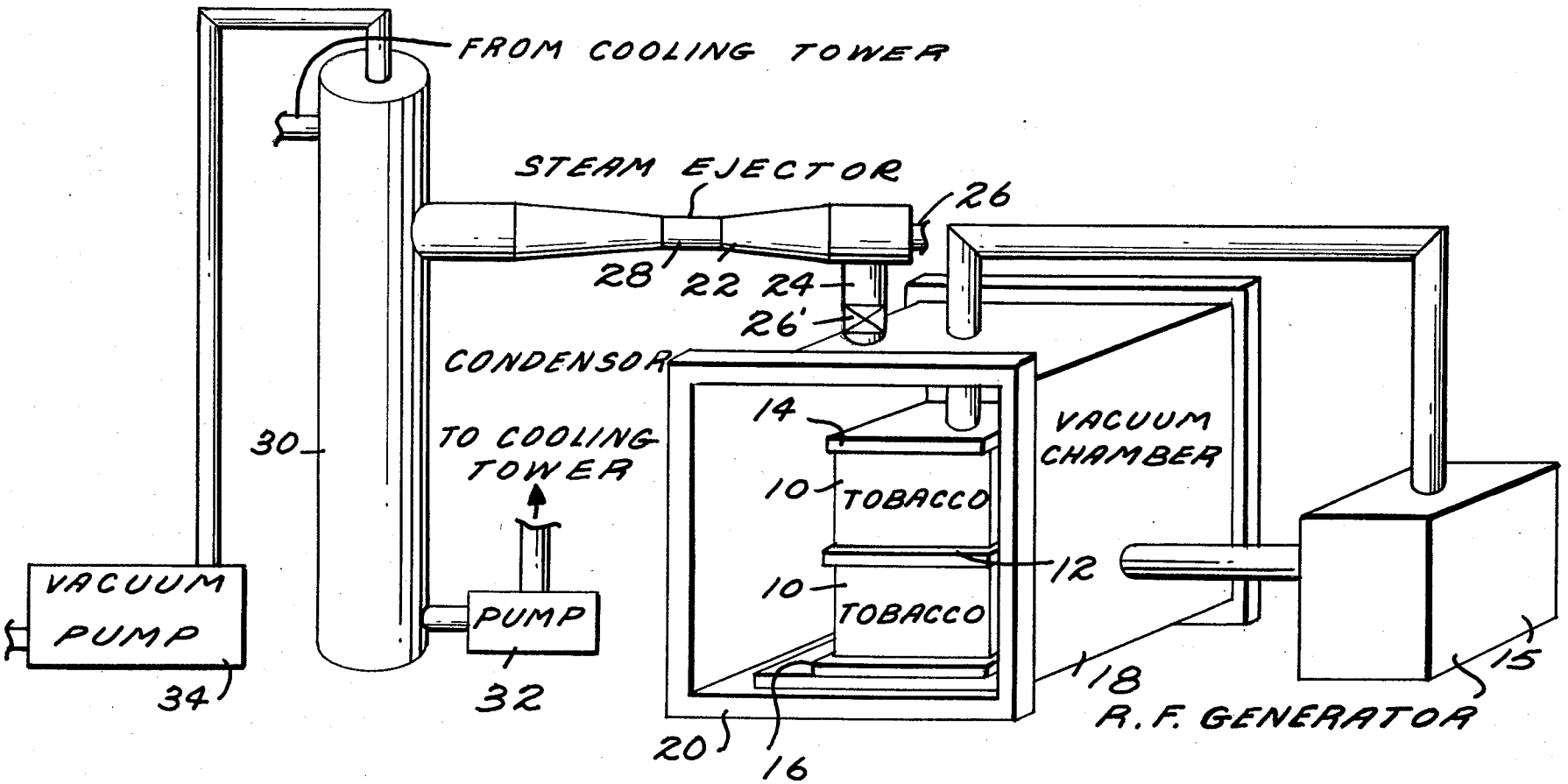
FROM COOLING TOWER
STEAM EJECTOR
26
28
22
24
26'
CONDENSOR
TO COOLING TOWER
PUMP
32
30
VACUUM PUMP
34
VACUUM CHAMBER
TOBACCO
TOBACCO
14
10
10
12
16
20
18
R.F. GENERATOR
15

PROCESS FOR PACKAGING LEAF TOBACCO

BACKGROUND AND SUMMARY OF THE INVENTION

The present invention relates to a method of treating leaf tobacco for storage and, more particularly, to a process where the moisture content of the leaf tobacco is regulated to minimize or eliminate degradation of the leaves as a result of packing of the leaves for storage.

In U.S. Pat. No. 2,124,012, to Smith, Jr., of July 19, 1938, there is proposed a drying process for leaves packed in a hogshead where, in a preferred embodiment, the packed hogshead is subjected to a radio frequency field to heat the tobacco leaves while, at the same time, the leaves are subjected to a relatively high vacuum to cause evaporation of the moisture. As an alternative, it is suggested that the tobacco be successively subjected to the vacuum evaporation and the action of an alternating electro-static field for heating. The advantage of first tightly packing the tobacco in a container and then reducing its moisture content by the use of a high frequency potential difference is that the leaves could be dried for aging without handling the leaves which become very fragile as their moisture content is reduced. It is, of course, essential that during the aging process, which may be for a period of two or more years, that the tobacco leaves by dried to avoid deterioration during the aging process. However, reduction of the moisture content of the tobacco leaves, as noted above, renders them quite fragile so that any handling frequently results in breakup of the leaves and loss of an appreciable amount of the product. As a result, the filling power of the tobacco will be correspondingly reduced.

While the Smith, Jr. patent proposes a solution to this problem, it has been found that the combination of a high vacuum together with electromagnetic heating of the tobacco leaf, particularly where the stems remain in the tobacco leaves, can be very time consuming and costly. In many circumstances, due to the problem of arcing at a very low vacuum, only a very low power electromagnetic field can be employed thus greatly prolonging the drying process. In addition, the presence of stems in the leaves has been found to further prolong the drying process since the stems contain a significant portion of the moisture of each leaf.

It is, accordingly, an object of the present invention to provide a method of treating leaf tobacco which is significantly more efficient than the processes of the prior art both in terms of the production output of the process as well as an overall increase in the filling power of the tobacco product.

In summary, according to a preferred embodiment of the present invention, the tobacco is tightly packed in a container that is non-conductive and where the leaves of the tobacco have had their stems removed. The packed containers are then first subjected to a heat treatment by exposing the containers to an electromagnetic field produced by a radio frequency generator to heat the leaves to a temperature of approximately 180° F. Thereafter, in the same or in a different chamber, the packed containers are subjected to a high vacuum to reduce the moisture content thereof and to reduce the temperature of the leaves. In some circumstances, it may be desirable to apply a low power electromagnetic field during the vacuum treatment to further reduce the moisture content of the leaves.

With the process of the present invention where the high temperature heat treatment precedes the vacuum treatment, the drying process can be effected for a packed container in substantially less time than was the case with the prior art processes where the heat treatment and vacuum were carried out simultaneously. By conducting the heat treatment at substantially atmospheric pressure, the problem of arcing in the electrical equipment was avoided.

The foregoing and other advantages of the present invention will become apparent as consideration is given to the following detailed description taken in conjunction with the drawing, in which:

BRIEF DESCRIPTION OF THE DRAWING

The single FIGURE is a schematic illustration of an apparatus useful in carrying out the steps of the present invention.

DETAILED DESCRIPTION OF THE INVENTION

In carrying out the method of the present invention, tobacco leaves which typically have a moisture content of from 15–25% are tightly packed in corrugated cardboard cartons with the individual leaves lying in substantially a flat condition. With this arrangement, the usual curling caused by shrinking of the tobacco leaves is minimized.

As illustrated in the drawing, the packed cartons 10 are disposed between conductive plates. In the illustrated arrangement, the middle plate 12 may be directly connected to the radio frequency generator 15 while the upper and lower plates 14 and 16 are connected to ground. While two cartons 10 are illustrated in superimposed position, it will be understood that, by elongating the respective plates 12, 14 and 16, four or six cartons may be simultaneously treated.

The radio frequency generator 15 operates in a conventional manner, well known to those skilled in this art, to impose an electromagnetic field between the plates which raises the temperature of the tobacco leaves and drives off the moisture in the leaves. Preferably, the leaves are heated to approximately 180° F. at this stage of the process.

For relatively small-scale operations, the heat treatment may be conducted in a chamber 18 while the chamber is at atmospheric pressure. For example, one end of the chamber 20 may be open to atmosphere. In high production capacity systems, the tobacco containers 10 will be subjected to the heat treatment in one location and then conveyed to the vacuum chamber 18 to avoid having portions of the system remain idle.

With the containers 10 disposed in the vacuum chamber, the vacuum chamber will be closed and sealed such as by closing the opening 20 by a suitable door or panel (not shown). Thereafter, a high vacuum is induced in the interior of the chamber 18. One manner of effecting this is by the conventional steam ejector 22. In this arrangement, a conduit 24 is opened through a suitable valve 26' to the interior of the chamber 18 and high pressure steam is injected from a conduit 26 through a Venturi 28 which results in a reduction in pressure in the interior of the chamber 18. Downstream of the ejector 22 a condenser 30 is provided where the water is cooled and then pumped through a pump 32 to a cooling tower (not shown). A vacuum pump 34 will be employed to maintain the area in the condenser above the water at a very low pressure. With this arrangement, the pressure in the vacuum chamber 18 can be reduced to approximately 0.2 inches of mercury at which pressure the moisture content of the tobacco product can be reduced to approximately 6–7%.

To further reduce the moisture content of the leaves, during the vacuum treatment, a lower power electromagnetic field may be imposed on the containers 10. Preferably, the power of the electromagnetic field is at least 50% less than that during the first heat treatment. This step will avoid the possibility of arcing taking place in the chamber 18 during the high vacuum stage. For example, where the first heat treatment may consume between 15 and 30 amps of current, the second heat treatment during the vacuum stage may be reduced to a current of 2–3 amps.

It has also been found that, by removing the stems of the leaves prior to subjecting them to the process of the present invention, the time period during which the leaves must be subjected to the vacuum can be decreased, thus reducing the amount of steam consumed in the process. This is due to the fact that, as noted above, the stems of the leaves constitute about 25% by weight of the leaves and contain a high percentage of the moisture in the leaves.

Having described the invention, it will be apparent to those skilled in the art that various modifications may be made thereto without departing from the spirit and scope of this invention as defined in the appended claims.

What is claimed is:

1. A method of treating leaf tobacco for storage comprising the steps of:

(a) tightly packing the leaves in a container that is non-conductive and with the leaves having a relatively high moisture content;

(b) subjecting the packed leaves to a heat treatment by exposing the packed container to an electromagnetic field to heat the leaves to a temperature of approximately 180° F. to thereby drive off a portion of the moisture in the leaves;

(c) subsequently, subjecting the packed leaves to a high vacuum to further reduce the moisture content thereof and to reduce the temperature of the leaves, and (d) the method further including the step of removing the stems from the tobacco leaves prior to packing the leaves in the container.

2. The method as claimed in claim 1 including the steps of placing the packed leaves in a chamber and subjecting the packed leaves to a vacuum of approximately 0.2 inches of mercury.

3. The method as claimed in claim 2 including the step of employing a steam ejector or vacuum pump means for inducing a vacuum in the chamber.

4. The method as claimed in claim 1 wherein the electromagnetic field is generated by applying high frequency alternating current to spaced conductive plates, one located on one side of the container and the other located on the opposite side thereof.

5. The method as claimed in claim 4 including the step of using three conductive plates and inserting a container of tobacco leaves between a first and second plate and another container of tobacco leaves between the second and third plates.

6. The method as claimed in claim 1, including the step of subjecting the packed leaves to the heat treatment in a first chamber at atmospheric pressure.

7. A method of treating leaf tobacco for storage comprising the steps of:

(a) tightly packing the leaves in a container that is non-conductive and with the leaves having a relatively high moisture content;

(b) subjecting the packed leaves to a heat treatment by exposing the packed container to an electromagnetic field to heat the leaves to a temperature of approximately 180° F. to thereby drive off a portion of the moisture in the leaves; and (c) subsequently, subjecting the packed leaves to a high vacuum to further reduce the moisture content thereof and to reduce the temperature of the leaves;

said electromagnetic field being generated by applying high frequency alternating current to spaced conductive plates, one located on one side of the container and the other located on the opposite side thereof;

the method including prior to step (b), the step of using three conductive plates and inserting a container of tobacco leaves between a first and second plate and another container of tobacco leaves between the second and third plates.

8. A method of treating leaf tobacco for storage comprising the steps of:

(a) tightly packing the leaves in a container that is non-conductive and with the leaves having a relatively high moisture content;

(b) subjecting the packed leaves to a heat treatment by exposing the packed container to an electromagnetic field to heat the leaves to a temperature of approximately 180° F. to thereby drive off a portion of the moisture in the leaves; and (c) subsequently, subjecting the packed leaves to a high vacuum to further reduce the moisture content thereof and to reduce the temperature of the leaves;

the method further including the steps of subjecting the packed leaves to the heat treatment in a first chamber at atmospheric pressure and moving the packed leaves to a second chamber and subjecting the packed leaves to the vacuum in said second chamber.

9. A method of treating leaf tobacco for storage comprising the steps of:

(a) tightly packing the leaves in a container that is non-conductive and with the leaves having a relatively high moisture content;

(b) subjecting the packed leaves to a heat treatment by exposing the packed container to an electromagnetic field to heat the leaves to a temperature of approximately 180° F. to thereby drive off a portion of the moisture in the leaves; and (c) subsequently, subjecting the packed leaves to a high vacuum to further reduce the moisture content thereof and to reduce the temperature of the leaves;

the method further including the step of, while subjecting the packed leaves to a vacuum, subjecting the leaves to another heat treatment.

10. The method as claimed in claim 9 wherein said another heat treatment is effected by exposing the packed leaves to an electromagnetic field.

11. The method as claimed in claim 10 wherein the intensity of said another heat treatment is substantially less than said first-mentioned heat treatment.

12. The method as claimed in claim 11, wherein the intensity of said another heat treatment is at least 50% less than said first heat treatment.

* * * * *